US011572682B2

(12) United States Patent
Kashimura et al.

(10) Patent No.: US 11,572,682 B2
(45) Date of Patent: Feb. 7, 2023

(54) FLUSH TOILET APPARATUS

(71) Applicant: TOTO LTD., Kitakyushu (JP)

(72) Inventors: Hideaki Kashimura, Fukuoka (JP); Hiroki Tanaka, Fukuoka (JP); Kenji Watanabe, Fukuoka (JP); Satoshi Takano, Fukuoka (JP); Yoshikatsu Adachi, Fukuoka (JP); Koichi Motooka, Fukuoka (JP); Yuki Hayashi, Fukuoka (JP)

(73) Assignee: TOTO LTD., Kitakyushu (JP)

( * ) Notice: Subject to any disclaimer, the term of this patent is extended or adjusted under 35 U.S.C. 154(b) by 0 days.

(21) Appl. No.: 17/669,407

(22) Filed: Feb. 11, 2022

(65) Prior Publication Data

US 2022/0275625 A1 Sep. 1, 2022

(30) Foreign Application Priority Data

Feb. 26, 2021 (JP) ..... JP2021-029703

(51) Int. Cl.
*E03D 11/11* (2006.01)
*E03D 1/28* (2006.01)
*E03D 5/10* (2006.01)

(52) U.S. Cl.
CPC ..... *E03D 11/11* (2013.01); *E03D 1/28* (2013.01); *E03D 5/10* (2013.01)

(58) Field of Classification Search
CPC ..... E03D 5/10; E03D 1/28; E03D 11/11
See application file for complete search history.

(56) References Cited

U.S. PATENT DOCUMENTS 7,814,582 B2 * 10/2010 Reddy ..... G01F 23/243 4/313

FOREIGN PATENT DOCUMENTS

JP 2016-118021 6/2016
JP 2017-133360 8/2017

* cited by examiner

*Primary Examiner* — Janie M Loeppke
(74) *Attorney, Agent, or Firm* — Amin, Turocy & Watson, LLP

(57) ABSTRACT

A flush toilet apparatus includes a toilet body that includes a rim water spout port, a tank that stores washing water, a rim side water supply channel that supplies washing water to the rim water spout port, a tank side water supply channel that supplies washing water to the tank, a flow channel switching part that adjusts an amount of washing water that is supplied to one or both of the rim side water supply channel and the tank side water supply channel, and an electrical power failure detection part that detects electrical power failure, wherein, in a case where electrical power failure is caused when washing water is supplied to the tank side water supply channel, the flow channel switching part decreases washing water that is supplied to the tank side water supply channel and increases washing water that is supplied to the rim side water supply channel.

9 Claims, 6 Drawing Sheets

FLUSH TOILET APPARATUS

CROSS-REFERENCE TO RELATED APPLICATION(S)

The present application claims the benefit of priority to Japanese Patent Application No. 2021-029703 filed on Feb. 26, 2021, the entire contents of which Japanese Patent Application are incorporated by reference in the present application.

FIELD

A disclosed embodiment(s) relate(s) to a flush toilet apparatus.

BACKGROUND

For a so-called hybrid-type flush toilet apparatus that executes a rim water spout and a jet water spout, a means has conventionally been known where, at a time of electrical power failure, a toilet washing valve is activated by a battery so as to supply a washing water thereto, a flapper valve of a water drainage socket plugs a water drainage flow channel of a toilet body simultaneously with supply of a washing water thereto so as to pool a washing water in a bowl part, and washing is executed by momentum of a flow of a pooled washing water (see, for example, Japanese Patent Application Publication No. 2017-133360 and Japanese Patent Application Publication No. 2016-118021).

However, a conventional flush toilet apparatus as described above is unsuitable because housing of a battery in a battery box by taking washing that is always executed at a time of electrical power failure into consideration is laborious, etc. Furthermore, in a case where a toilet washing valve is activated by, for example, a capacitor, other than a battery, it is not possible to execute toilet washing as a lack of a capacitance of such a capacitor is caused, etc., where it is also unsuitable.

Hence, for a mechanical washing means that does not use electrical power, two wires, for example, a wire for water supply and a wire for water drainage that opens or closes a flapper valve of a water drainage socket are operated, so that it is possible to execute toilet washing.

However, for a mechanical washing means, in a case where a toilet washing valve is provided in a state where a lot of water is supplied to a tank that supplies a washing water to a jet water spout port at a moment when electrical power failure is caused, there is a possibility that a situation where a tank is filled with water and/or a situation where water is leaked to an outside of such a tank (machine exterior water leakage is caused) is/are caused.

SUMMARY

A flush toilet apparatus that discharges waste to a water drainage pipe by washing water, according to an aspect of an embodiment, includes a toilet body that includes a bowl part that receives waste, a rim water spout port that spouts washing water to the bowl part, and a drainage water trap pipeline that is connected to a bottom part of the bowl part and discharges waste from the bowl part to the water drainage pipe, a tank that stores washing water that is supplied from a water supply channel, an on-off valve that opens or closes the water supply channel, a rim side water supply channel that supplies washing water to the rim water spout port through a branching part that is provided on a downstream side of the water supply channel, a tank side water supply channel that supplies washing water to the tank through the branching part, a flow channel switching part that is provided on the branching part and is operated to adjust an amount of washing water that is supplied to one or both of the rim side water supply channel and the tank side water supply channel, a control part that controls the on-off valve and the flow channel switching part, and an electrical power failure detection part that detects electrical power failure, wherein, in a case where the electrical power failure detection part detects electrical power failure when washing water is supplied to the tank side water supply channel, the flow channel switching part decreases washing water that is supplied to the tank side water supply channel and increases washing water that is supplied to the rim side water supply channel.

BRIEF DESCRIPTION OF DRAWING(S)

DESCRIPTION OF EMBODIMENT(S)

Hereinafter, an embodiment(s) of a flush toilet apparatus as disclosed in the present application will be explained in detail with reference to the accompanying drawing(s). Additionally, this invention is not limited by an embodiment(s) as illustrated below.

Figure 1:
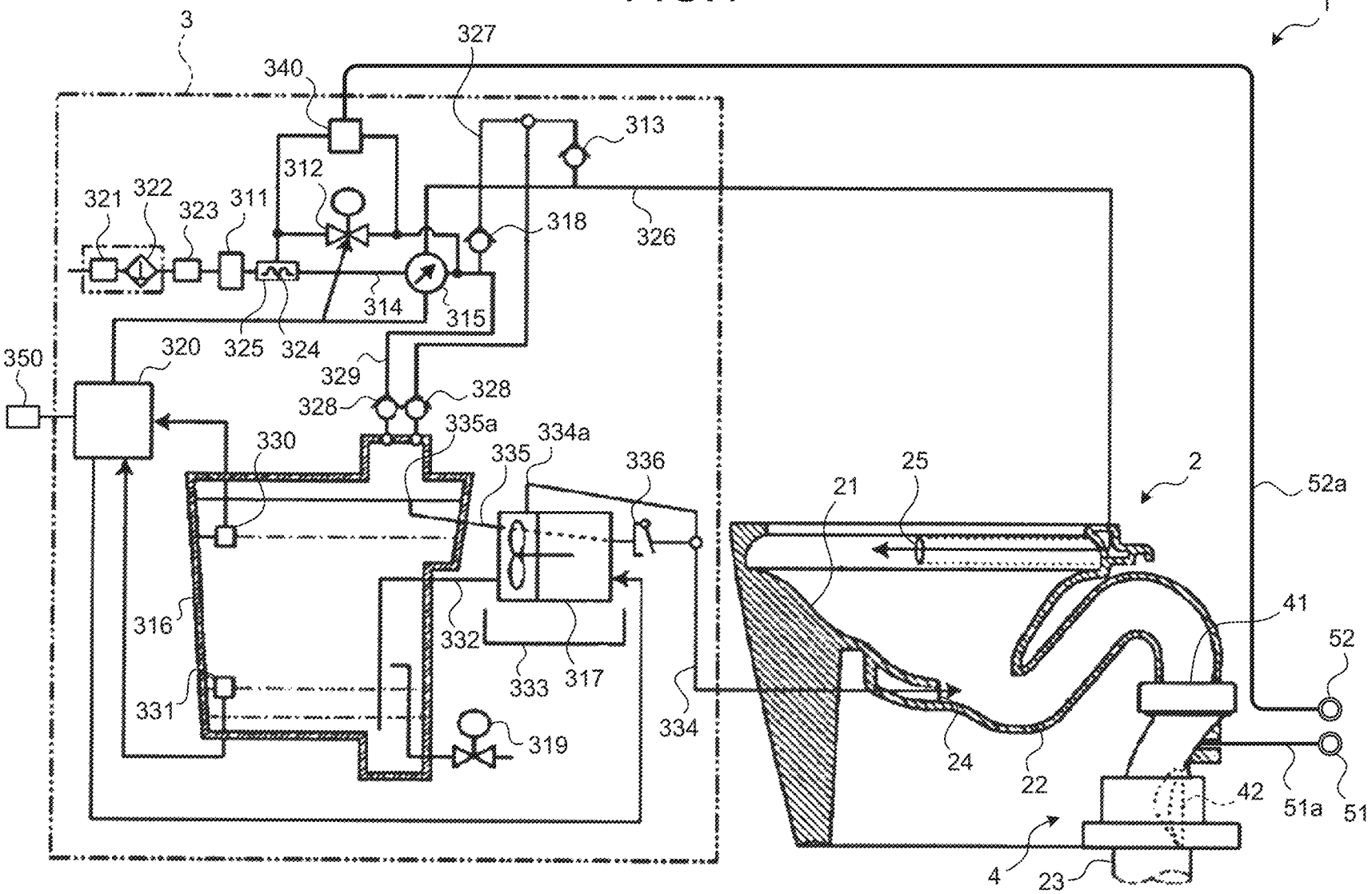
FIG. 1 is a diagram that illustrates a general configuration of a flush toilet apparatus according to an embodiment.

First, a general configuration of a flush toilet apparatus 1 according to an embodiment will be explained with reference to FIG. 1. FIG. 1 is a diagram that illustrates a general configuration of the flush toilet apparatus 1 according to an embodiment.

As illustrated in FIG. 1, the flush toilet apparatus 1 includes a toilet body 2, a toilet washing device 3, a water drainage socket 4, and manual operation parts 51, 52.

The toilet body 2 includes a bowl part 21 that receives waste and a drainage water trap pipeline 22 that is connected to the bowl part 21 and guides waste in the bowl part 21 to a water drainage pipe 23.

A jet water spout port 24 that spouts a washing water toward the drainage water trap pipeline 22 and a rim water spout port 25 that spouts a washing water from a rim that is formed on an upper edge part of the bowl part 21 so as to form a swirling flow of a washing water in the bowl part 21 are formed on the bowl part 21.

The drainage water trap pipeline 22 has a rising channel part that extends upward from an inlet thereof and a falling channel part that extends downward from a terminal of such a rising channel part and is connected to the water drainage socket 4. Additionally, a washing water (a pooled water) for forming a water seal state is stored from the bowl part 21 to such a rising channel part of the drainage water trap pipeline 22.

The water drainage socket 4 includes a connection flow channel 41 and is provided between the drainage water trap pipeline 22 and the water drainage pipe 23. Then, the water drainage socket 4 connects the drainage water trap pipeline 22 and the water drainage pipe 23 through the connection flow channel 41.

Thus, in the toilet body 2, a water drainage channel that connects the bowl part 21 and the water drainage pipe 23 is formed by the drainage water trap pipeline 22 and the connection flow channel 41. The toilet body 2 is a so-called hybrid type that executes a rim water spout from the rim water spout port 25 by a direct pressure of a water tap and executes water drainage by opening or closing of the water drainage socket 4.

In such a toilet body 2, a siphon action is efficiently caused by a washing water that is spouted from the jet water spout port 24 and the siphon action as described above is utilized so as to draw waste in the bowl part 21 into a water drainage channel and discharge it to the water drainage pipe 23.

Furthermore, the water drainage socket 4 includes an on-off valve body 42. The on-off valve body 42 is provided on the connection flow channel 41 that is a part of a water drainage channel, and opens or closes the water drainage channel (the connection flow channel 41). Additionally, for example, a flapper valve is used for the on-off valve body 42.

The manual operation part (that will be referred to as a first operation part below) 51 is connected to the on-off valve body 42 through a first wire 51*a* that is a transmission part that transmits a manual operation that is executed by a user. The first operation part 51 is, for example, a member with a ring shape that receives a manual operation of a user in a case where toilet washing is executed at a time of electrical power failure.

Furthermore, for the first wire 51*a*, it is possible to use, for example, a release wire. Specifically, the first wire 51*a* includes an outer tube and an inner wire that is inserted into and is provided on an inside of the outer tube although no illustration thereof is provided. As described above, one end of an inner wire of the first wire 51*a* is connected to the on-off valve body 42 while another end thereof is connected to the first operation part 51.

For example, as a user manually executes an operation for the first operation part 51 such as pulling of the first operation part 51 (a pull operation), an inner wire of the first wire 51*a* is moved so as to rotate the on-off valve body 42.

In such a case, the on-off valve body 42 is maintained in an opened state thereof in a normal time when the first operation part 51 is not operated. Therefore, the on-off valve body 42 does not change a flow channel cross-sectional area of the connection flow channel 41 in a normal time.

On the other hand, as a user executes a pull operation for the first operation part 51, the on-off valve body 42 is rotated in association with movement of an inner wire so as to provide a closed state thereof, that is, a state where a flow channel cross-sectional area of the connection flow channel 41 is decreased.

Additionally, the on-off valve body 42 does not have to close the connection flow channel 41 completely. That is, it is sufficient to raise a water level in the bowl part 21 relative to an initial water level by a washing water that is supplied from the rim water spout port 25 and the jet water spout port 24, so that a slight gap may be present between the on-off valve body 42 and the connection flow channel 41.

Additionally, the first operation part 51 is arranged in an inside of a decorative panel (non-illustrated) that is provided behind the toilet body 2 and is provided in a state where it is not possible to view it from an outside. It is possible for a user to execute a manual operation of the first operation part 51 by detaching a decorative panel.

Furthermore, the manual operation part (that will be referred to as a second operation part below) 52 is connected to a switching part 340 through a second wire 52*a* that is a transmission part. The second operation part 52 is, for example, a member with a ring shape that receives a manual operation of a user in a case where toilet washing is executed at a time of electrical power failure, similarly to the first operation part 51 as described above.

Furthermore, for the second wire 52*a*, it is possible to use, for example, a release wire, similarly to the first wire 51*a* as described above. In such a case, the second wire 52*a* includes an outer tube and an inner wire that is inserted into and is provided on an inside of the outer tube, similarly to the first wire 51*a*. The second wire 52*a* joins a manual operation valve (non-illustrated) and the second operation part 52 so as to transmit an operation of the second operation part 52 to the manual operation valve.

The toilet washing device 3 is arranged on a back part of the toilet body 2. For example, the toilet washing device 3 is connected to an external electrical power source (non-illustrated) and drives a component(s) such as an electromagnetic valve by using external electrical power that is supplied from the external electrical power source, at a time of no electrical power failure, so as to supply a washing water to the bowl part 21.

The toilet washing device 3 includes a constant flow valve 311, an on-off valve (that will be referred to as an electromagnetic valve below) 312, and a vacuum breaker for a rim water spout 313. A water supply channel 314 has a flow channel switching part (that will also be referred to as a toilet washing valve) 315 that switches between water supply to a tank 316 that stores a washing water and a rim water spout, the tank 316, a pressurization pump 317, a vacuum breaker for a jet water spout 318, and a water drainage plug 319.

Furthermore, the toilet washing device 3 has a control part 320 that controls an opening or closing operation of the electromagnetic valve 312, a switching operation of the flow channel switching part 315, a pressurization operation of the pressurization pump 317, and the like.

The constant flow valve 311 narrows a washing water that flows therein through a water shut-off valve 321, a strainer 322, and a branching fitting 323, down to a predetermined flow rate or less. For example, the constant flow valve 311 restricts a flow rate of a washing water to 16 liters/minute or less. A washing water that passes through the constant flow valve 311 flows into the electromagnetic valve 312 and a washing water that passes through the electromagnetic valve 312 is supplied to the rim water spout port 25 or the tank 316 by the flow channel switching part 315.

The electromagnetic valve 312 is a diaphragm-type electromagnetic on-off valve that is opened or closed by control of the control part 320. The water supply channel 314 is provided with a diaphragm 324 and is provided with a pressure chamber 325 that is adjacent to the diaphragm 324.

The electromagnetic valve 312 changes a pressure in the pressure chamber 325 so as to operate the diaphragm 324 and control a flow of a washing water in the water supply channel 314.

Specifically, the electromagnetic valve 312 is provided in an opened valve state as an open signal is input from the control part 320 thereto, so that a pressure in the pressure chamber 325 falls, the diaphragm 324 opens the water supply channel 314, and a supplied washing water flows into the flow channel switching part 315. On the other hand, the electromagnetic valve 312 is provided in a closed valve state as a close signal is input from the control part 320 thereto, so that a pressure in the pressure chamber 325 rises, the diaphragm 324 closes or plugs the water supply channel 314, and supply of a washing water to the flow channel switching part 315 is stopped.

The flow channel switching part 315 is switched by a control signal of the control part 320, so that a washing water that flows therein through the electromagnetic valve 312 is spouted from the rim water spout port 25 or flows into the tank 316.

The vacuum breaker for a rim water spout 313 is arranged in a middle of a rim side water supply channel 326 that guides a washing water that passes through the flow channel switching part 315 to the rim water spout port 25, so as to prevent a backward flow of a washing water from the rim water spout port 25. Furthermore, the vacuum breaker for a rim water spout 313 is arranged above an upper end surface of the bowl part 21 so as to prevent a backward flow reliably. Furthermore, a washing water that overflows from an atmospheric relief part of the vacuum breaker for a rim water spout 313 flows through a return pipeline 327 and flows into the tank 316 through a float-type check valve 328.

The tank 316 stores a washing water that should be spouted from the jet water spout port 24. For example, the tank 316 has an inner volume of about 2.5 liters.

In the present embodiment, a tip (a lower end) of a tank side water supply channel 329 is connected to the float-type check valve 328 so as to prevent a backward flow from the tank 316 to the tank side water supply channel 329. Furthermore, an upper end float switch 330 and a lower end float switch 331 are arranged in an inside of the tank 316, so that it is possible to detect a water level in the tank 316.

As a water level in the tank 316 reaches a predetermined water level of a stored water, the upper end float switch 330 is switched on, so that the control part 320 detects it and closes the electromagnetic valve 312. On the other hand, as a water level in the tank 316 decreases to a predetermined water level, the lower end float switch 331 is switched on, so that the control part 320 detects it and stops the pressurization pump 317.

The pressurization pump 317 pressurizes a washing water that is stored in the tank 316, so as to spout it from the jet water spout port 24. The pressurization pump 317 is connected to a pump side water supply channel 332 that extends from the tank 316, so as to pressurize a washing water that is stored in the tank 316. For example, the pressurization pump 317 pressurizes a washing water in the tank 316 so as to spout such a washing water from the jet water spout port 24 at a maximum flow rate of about 120 liters/minute.

The water drainage plug 319 is arranged at a position near a lower end part of the tank 316 and below the pressurization pump 317. Hence, the water drainage plug 319 is opened, so that it is possible to discharge a washing water in the tank 316 and in the pressurization pump 317 at a time of maintenance or the like. Furthermore, a water-receiving tray 333 is arranged below the pressurization pump 317. The water-receiving tray 333 receives a dew condensation water drop(s) and/or a leaked water.

On the other hand, an outflow port of the pressurization pump 317 is connected to the jet water spout port 24 on a bottom part of the bowl part 21 through a jet side water supply channel 334. A middle of the jet side water supply channel 334 is formed into an upwardly protruding shape and a jet side water supply channel top part **334*a* that is a highest part of a part with a protruding shape is a highest part of a washing water pipeline that leads to the jet water spout port 24 from the tank 316. Furthermore, a downstream side of the jet side water supply channel top part 334*a* of the jet side water supply channel 334 is set at a height that is identical to that of the jet water spout port 24**.

An overflow pipe 335 that has an overflow port **335*a* is connected to one end of the jet side water supply channel 334. The overflow port 335*a* is provided above the upper end float switch 330. In a case where a water level in the tank 316 is higher than the upper end float switch 330, water in the tank 316 flows into the overflow pipe 335 from the overflow port 335*a*, is pressurized by the pressurization pump 317, and is spouted from the jet water spout port 24 through a flapper valve 336**.

The vacuum breaker for a jet water spout 318 is arranged in a middle of the tank side water supply channel 329 that guides a washing water that passes through the flow channel switching part 315 to the tank 316, so as to prevent a backward flow of a washing water from the tank 316. A washing water that overflows from an atmospheric relief part of the vacuum breaker for a jet water spout 318 flows through the return pipeline 327 and flows into the tank 316 through the float-type check valve 328.

The control part 320 sequentially operates the electromagnetic valve 312, the flow channel switching part 315, and the pressurization pump 317 by an operation of a toilet washing switch (non-illustrated) that is executed by a user, so as to start a water spout from the rim water spout port 25 and the jet water spout port 24 sequentially and wash the bowl part 21. Furthermore, after washing is ended, the control part 320 opens the electromagnetic valve 312 and switches the flow channel switching part 315 into a side of the tank 316 so as to resupply a washing water to the tank 316. As a water level in the tank 316 rises and the upper end float switch 330 detects a defined amount of a stored water, the control part 320 closes the electromagnetic valve 312 so as to stop water supply.

Additionally, the control part 320 is realized by, for example, a Central Processing Unit (CPU), a Micro Processing Unit (MPU), and/or the like that execute(s) a program that is stored in a storage unit (non-illustrated) while a Random Access Memory (RAM) is provided as a working area. Furthermore, a storage unit (non-illustrated) is realized by, for example, a semiconductor memory element such as an RAM and/or a flash memory or the like.

An electrical power failure detection part 350 is connected to the control part 320. For example, the electrical power failure detection part 350 monitors a current-carrying signal so as to detect electrical power failure. The electrical power failure detection part 350 detects electrical power failure in a case where a current-carrying signal is interrupted for a time period that is longer than a time period of a so-called instantaneous electrical power failure (that will also be referred to as instantaneous failure or instantaneous interruption) where a current-carrying signal is interrupted for only a moment even in a normal time.

Figure 2:
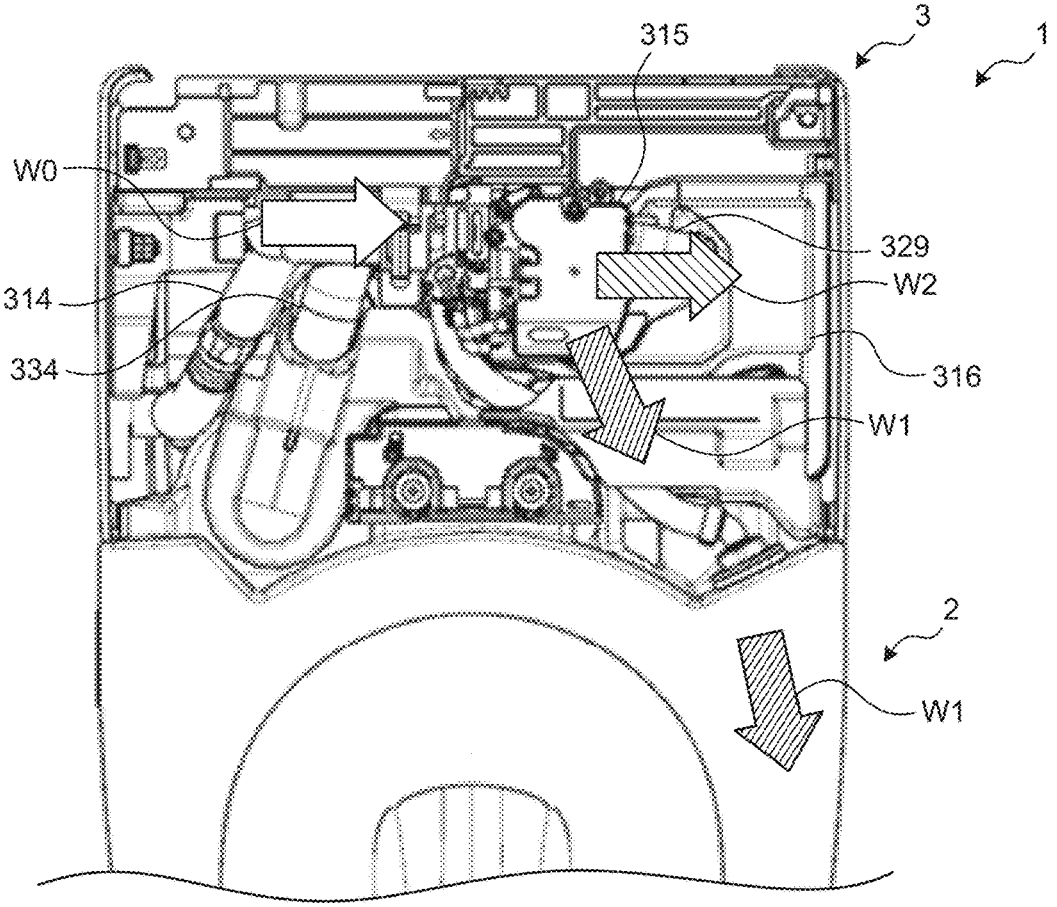
FIG. 2 is a plan view that illustrates a toilet washing device.
Figure 3:
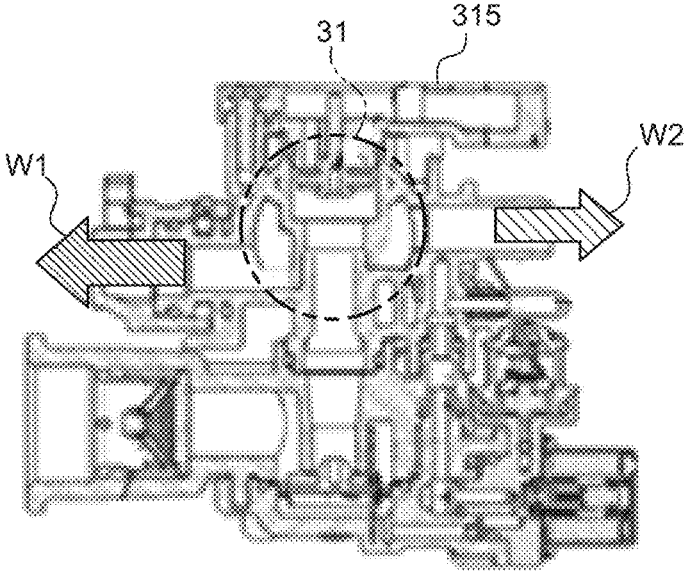
FIG. 3 is a cross-sectional side view that illustrates a flow channel switching part.

Next, flows of washing waters W0, W1, W2 in the toilet washing device 3 that includes the flow channel switching part 315 of the flush toilet apparatus 1 will be explained with reference to FIG. 2 and FIG. 3. FIG. 2 is a plan view that illustrates the toilet washing device 3. FIG. 3 is a cross-sectional side view that illustrates the flow channel switching part 315.

As illustrated in FIG. 2 and FIG. 3, in the flush toilet apparatus 1, the flow channel switching part 315 supplies a washing water W0 that is supplied from the water supply channel 314 to one or both of the rim side water supply channel 326 and the tank side water supply channel 329 at a branching part 31 for a washing water. Thus, the flow channel switching part 315 is operated so as to adjust an amount of a washing water that is supplied to one or both of the rim side water supply channel 326 and the tank side water supply channel 329.

A washing water W1 that is supplied to the rim side water supply channel 326 by the flow channel switching part 315 is spouted from the rim water spout port 25 (see FIG. 1) and washes (rim-washes) an inside of the bowl part 21. Furthermore, a washing water W2 that is supplied to the tank side water supply channel 329 by the flow channel switching part 315 is spouted from the jet water spout port 24 (see FIG. 1).

Figure 4:
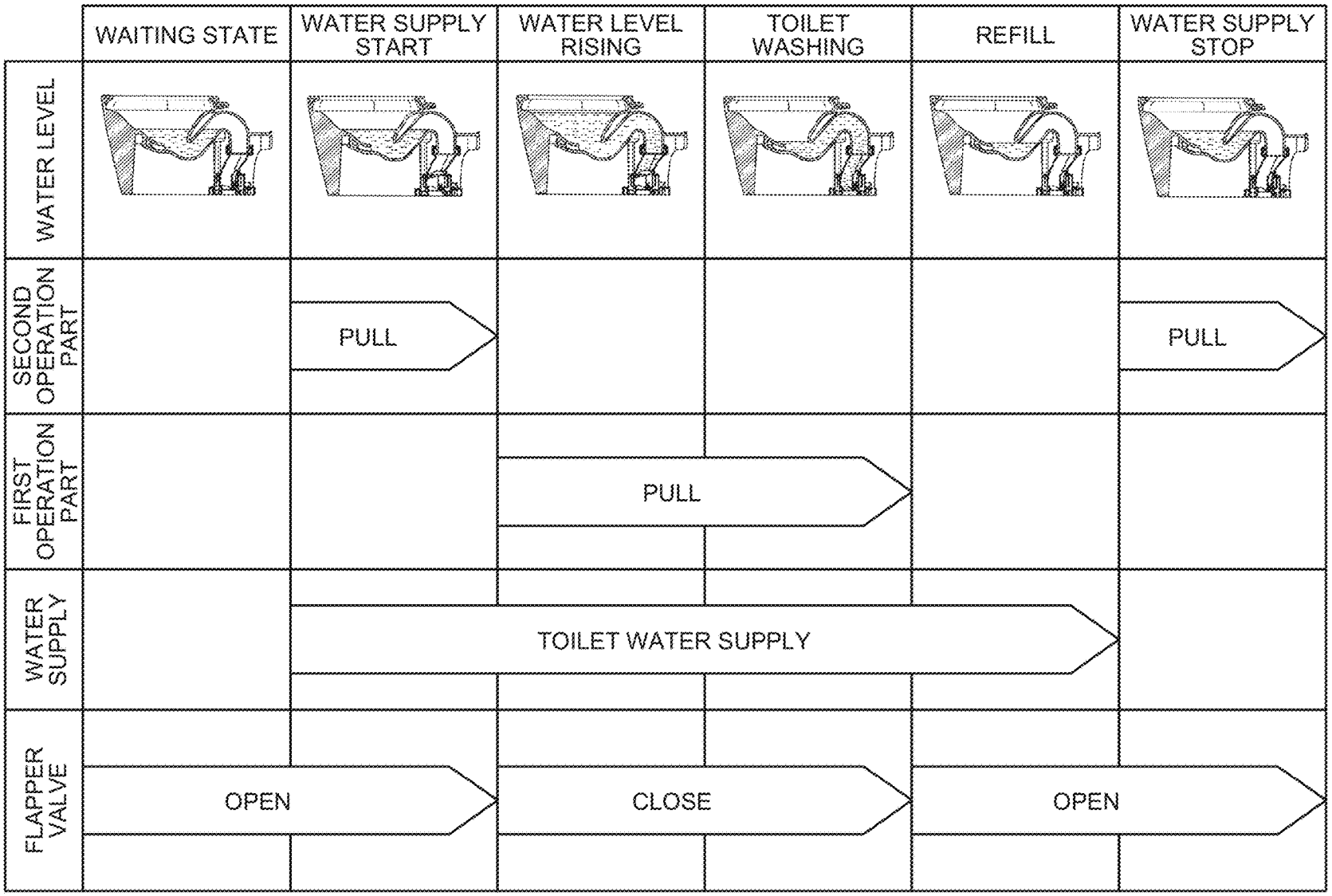
FIG. 4 is a diagram that illustrates an example of a procedure of a toilet washing operation at a time of electrical power failure.

Herein, a toilet washing operation at a time of electrical power failure in the flush toilet apparatus 1 will be explained with reference to FIG. 4. FIG. 4 is a diagram that illustrates an example of a procedure of a toilet washing operation at a time of electrical power failure.

As illustrated in FIG. 4, the flush toilet apparatus 1 (see FIG. 1) in a waiting state at a time of electrical power failure is provided in a state where a washing water is pooled in the bowl part 21 (see FIG. 1) and the on-off valve body (flapper valve) 42 of the water drainage socket 4 is opened. Then, as the second operation part 52 (see FIG. 1) is pull-operated by a user, water supply to the bowl part 21 is started.

Then, as the first operation part 51 (see FIG. 1) is pull-operated by a user, the on-off valve body (flapper valve) 42 is provided in a closed state thereof, so that a water level in the bowl part 21 rises and toilet washing is started.

Then, as a pull operation of the first operation part 51 that is executed by a user is ended, the flush toilet apparatus 1 is provided in a state where the on-off valve body (flapper valve) 42 is opened. Herein, water supply to the bowl part 21 is continued, so that a washing water is resupplied (refilled) to the bowl part 21. Then, as the second operation part 52 is pull-operated by a user again, the flush toilet apparatus 1 stops water supply to the bowl part 21 so as to end toilet washing.

Thus, a mechanical washing means is provided in the present embodiment, so that it is possible to attain toilet washing by the flow channel switching part 315 in not only a waiting state but also any state (for example, while a washing water is supplied to the rim side water supply channel 326, while a washing water is supplied to the tank side water supply channel 329, or the like).

Meanwhile, as a user pull-operates the second operation part 52 that is an operation part for water supply in a case where electrical power failure is detected while a washing water is supplied to the tank side water supply channel 329, a state is provided where a washing water flows from the jet water spout port 24. Hence, it is not possible for a user to view a washing water that flows from the rim water spout port 25 and forgetting to close a water supply side may be caused, so that there is a possibility that a situation where the tank 316 is filled with water and/or a situation where water is leaked to an outside of the tank 316 is/are caused.

Furthermore, as described above, in a case where electrical power failure is caused (for example, at a moment when electrical power failure is caused), there is a possibility that a situation where the tank 316 is filled with water and/or a situation where water is leaked to an outside of the tank 316 is/are caused, also in a case where a toilet washing valve is provided in a state where a lot of water is supplied to the tank 316 that supplies a washing water to a jet water spout port. Moreover, in a case where jamming of dust on the float-type check valve 328 of the tank 316 is caused, there is a possibility that a situation where water is leaked to an outside of the tank 316 is caused.

Hence, in the present embodiment, even if the flow channel switching part 315 at a moment when electrical power failure is caused is provided in a state where a lot of water is supplied to a tank, flow channel adjustment is executed so as to increase a washing water that is supplied to the rim side water supply channel 326.

Figure 5A:
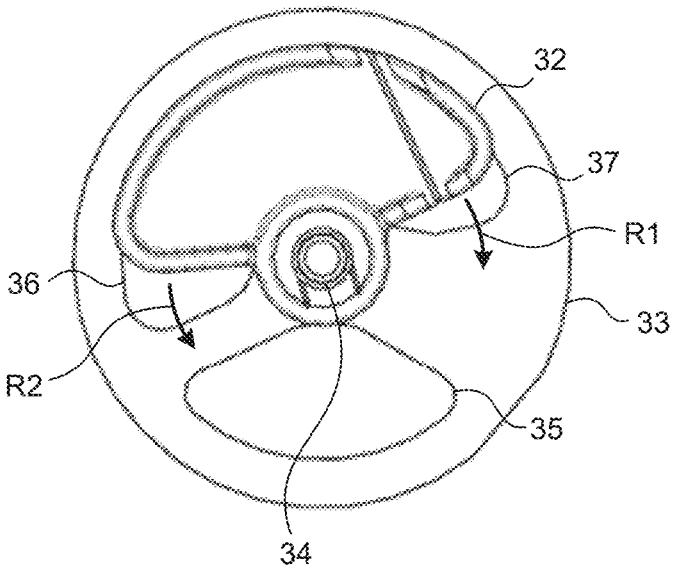
FIG. 5A is a plan view that illustrates a movable part and a fixation part of a flow channel switching part.
Figure 5B:
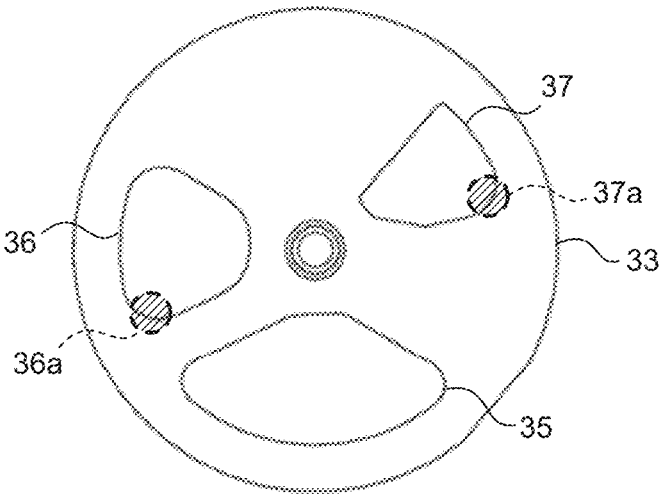
FIG. 5B is a plan view that illustrates the fixation part of the flow channel switching part.

FIG. 5A is a plan view that illustrates a movable part 32 and a fixation part 33 of the flow channel switching part 315 and FIG. 5B is a plan view that illustrates the fixation part 33 of the flow channel switching part 315. As illustrated in FIG. 5A, the flow channel switching part 315 (see FIG. 3) includes the movable part (that will be referred to as a rotor below) 32 and the fixation part (that will be referred to as a stator below) 33.

The rotor 32 is formed into a fan plate shape, mutually faces a surface of the stator 33, and is arranged so as to overlap with the stator 33. The rotor 32 is provided so as to be rotatable around a rotation axis 34 as a center thereof.

As illustrated in FIG. 5B, the stator 33 is formed into a circular plate shape. The stator 33 has a water supply side opening part 35, a rim side opening part 36, and a tank side opening part 37. The water supply side opening part 35 causes a washing water that is supplied from the water supply channel 314 (see FIG. 2) to flow therein.

The rim side opening part 36 supplies a washing water from the water supply channel 314 (see FIG. 2) to the rim side water supply channel 326 (see FIG. 2). For example, the rim side opening part 36 is formed into a polygonal shape. Preferably, the rim side opening part 36 is formed into a triangular shape. The tank side opening part 37 supplies a washing water from the water supply channel 314 to the tank side water supply channel 329 (see FIG. 2). Additionally, the tank side opening part 37 may be formed into a triangular shape, similarly to the rim side opening part 36.

As illustrated in FIG. 5A, the rotor 32 rotates around the rotation axis 34 as a center thereof in a rotation direction R1, so as to further open a side of the rim side opening part 36. Furthermore, the rotor 32 rotates around the rotation axis 34 as a center thereof in a rotation direction R2, so as to further open a side of the tank side opening part 37. The tank side opening part 37 is formed into a protruding shape, in the rotation direction R1 where the rim side opening part 36 of the rotor 32 is opened, on a downstream side of the rotation direction R1. Thus, it is formed into a protruding shape on a downstream side of the rotation direction R1, so that supply of a washing water to the rim side water supply channel 326 (see FIG. 2) is increased by a slight rotation of the rotor 32.

Furthermore, a protrusion part 36*a* of the rim side opening part 36 on a most downstream side of the rotation direction R2 of the rotor 32 is positioned on a downstream side of the rotation direction R2 relative to a protrusion part 37*a* of the tank side opening part 37 on a most downstream side of the rotation direction R1 of the rotor 32. Also in such a positional relationship between the two protrusion parts 36*a*, 37*a*, supply of a washing water to the rim side water supply channel 326 (see FIG. 2) is increased by a slight rotation of the rotor 32.

Furthermore, it is preferable that an opening area of the rim side opening part 36 is greater than an opening area of the tank side opening part 37. Thus, an opening area of the rim side opening part 36 is greater than an opening area of the tank side opening part 37, so that supply of a washing water to the rim side water supply channel 326 (see FIG. 2) is also increased by a slight rotation of the rotor 32.

Figure 6:
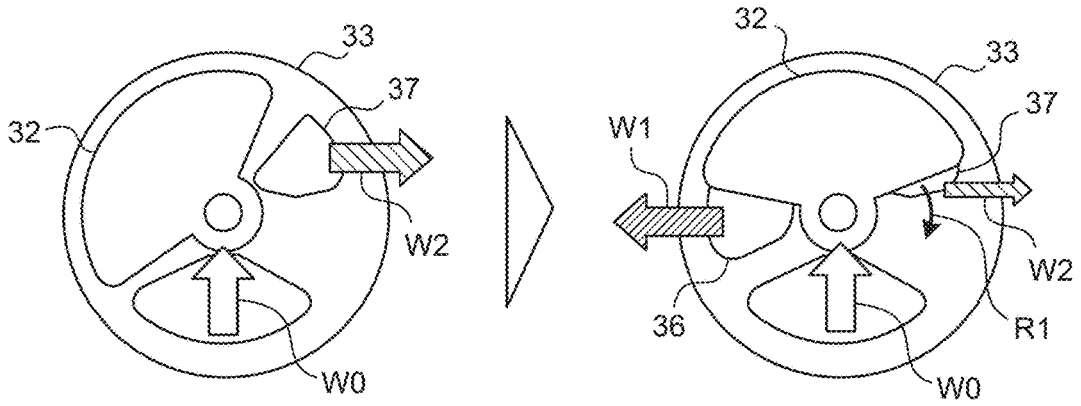
FIG. 6 is an operation explanatory diagram (part 1) of a flow channel switching part at a time when electrical power failure is caused.

FIG. 6 is an operation explanatory diagram (part 1) of the flow channel switching part 315 at a time when electrical power failure is caused. As described above, the control part 320 (see FIG. 1) controls an operation of the flow channel switching part 315 (a rotation operation of the rotor 32).

The control part 320 controls the rotor 32 in such a manner that, in a case where the rotor 32 opens the tank side opening part 37 of the stator 33 as illustrated in FIG. 6 (a left side in the figure), the rim side opening part 36 is opened as illustrated in FIG. 6 (a right side in the figure) at a moment when the electrical power failure detection part 350 (see FIG. 1) detects electrical power failure, so as to decrease a washing water W2 that is supplied to the tank side water supply channel 329 (see FIG. 1) and increase a washing water W1 that is supplied to the rim side water supply channel 326 (see FIG. 1). More specifically, the control part 320 controls the rotor 32 so as to increase a washing water W1 that is supplied to the rim side water supply channel 326 relative to a washing water W2 that is supplied to the tank side water supply channel 329.

Additionally, it is preferable for the control part 320 to open the rim side opening part 36 and close the tank side opening part 37 at a moment when the electrical power failure detection part 350 detects electrical power failure, so as to provide all of a washing water W0 that is supplied thereto as a washing water W1 that is supplied to the rim side water supply channel 326.

The flush toilet apparatus 1 includes a capacitor for supplying electrical power for driving of each site such as the electromagnetic valve 312 (see FIG. 1). Furthermore, the flush toilet apparatus 1 separately includes, in the capacitor as described above, a capacitor 71 (see FIG. 9) for driving the rotor 32 in order to increase a washing water W1 that is supplied to the rim side water supply channel 326, at a moment when the electrical power failure detection part 350 detects electrical power failure. The capacitor 71 supplies electrical power to the control part 320, so that it is possible for the control part 320 to drive the rotor 32, and hence, it provides a driving force to the rotor 32 through the control part 320.

In such a case, the control part 320 controls electrical power supply from the capacitor 71 in such a manner that the flow channel switching part 315 (the rotor 32) does not supply a washing water to the tank side water supply channel 329, at a moment when the electrical power failure detection part 350 detects electrical power failure when a washing water is supplied to the tank side water supply channel 329.

Thus, the capacitor 71 is a dedicated capacitor for driving the flow channel switching part 315 (the rotor 32).

Furthermore, the control part 320 rotates the rotor 32 by a motor (non-illustrated). Additionally, a plurality of components (such as gears) are joined between a motor and the rotor 32 in order to transmit a driving force to the rotor 32.

Figure 7:
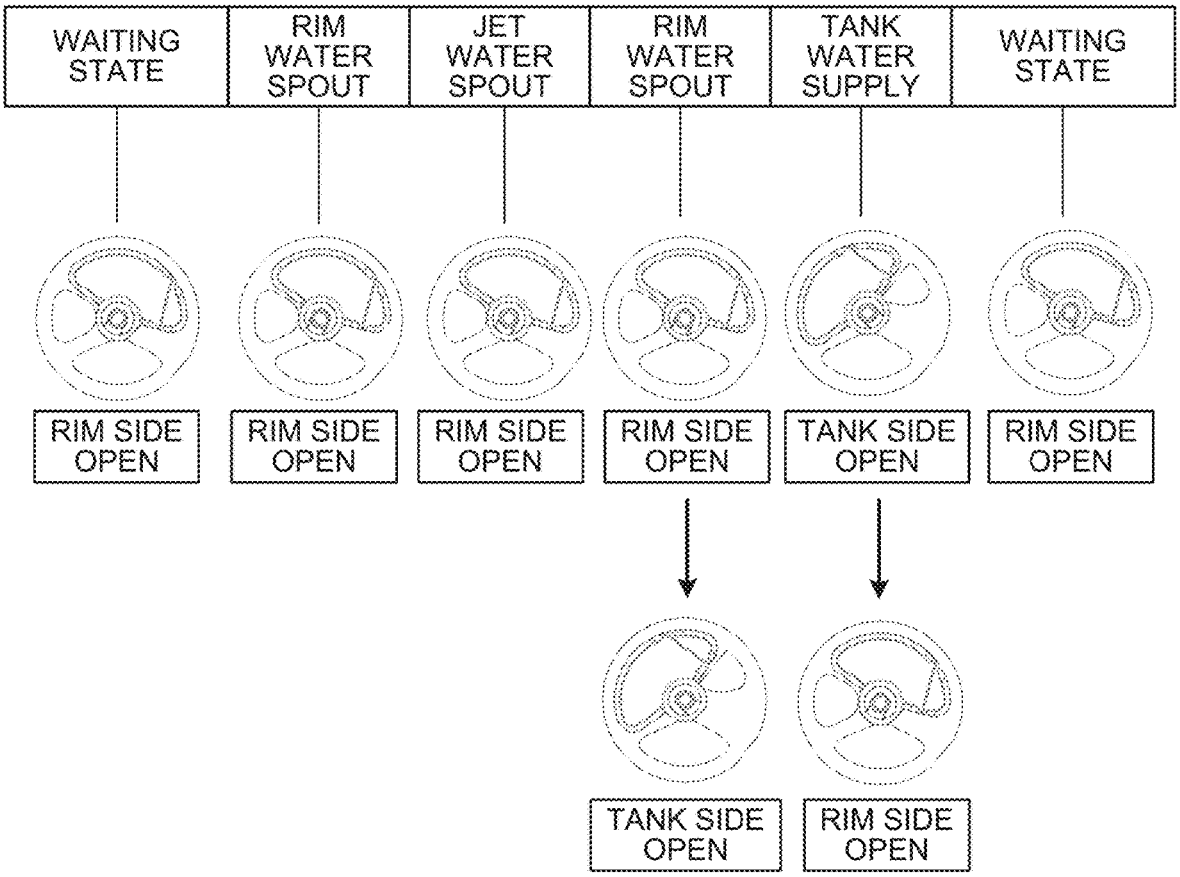
FIG. 7 is an operation explanatory diagram (part 2) of a flow channel switching part at a time when electrical power failure is caused.

FIG. 7 is an operation explanatory diagram (part 2) of the flow channel switching part 315 at a time when electrical power failure is caused. As illustrated in FIG. 7, the flow channel switching part 315 opens the rim side opening part 36 in a waiting state in a normal time. Furthermore, the flow channel switching part 315 opens the rim side opening part 36 while a rim water spout to a jet water spout are executed. The flow channel switching part 315 also opens the rim side opening part 36 while a jet water spout to a rim water spout are executed. The flow channel switching part 315 switches from a rim water spout to tank water supply, and the tank side opening part 37 is opened during such tank water supply.

The control part 320 controls the flow channel switching part 315 so as not to supply a washing water to the tank side water supply channel 329 at a moment when the electrical power failure detection part 350 detects electrical power failure in a case where a washing water is supplied to the tank side water supply channel 329. That is, the control part 320 controls the flow channel switching part 315 so as to close the tank side opening part 37 and open the rim side opening part 36 in a case where electrical power failure is caused during tank water supply.

Figure 8:
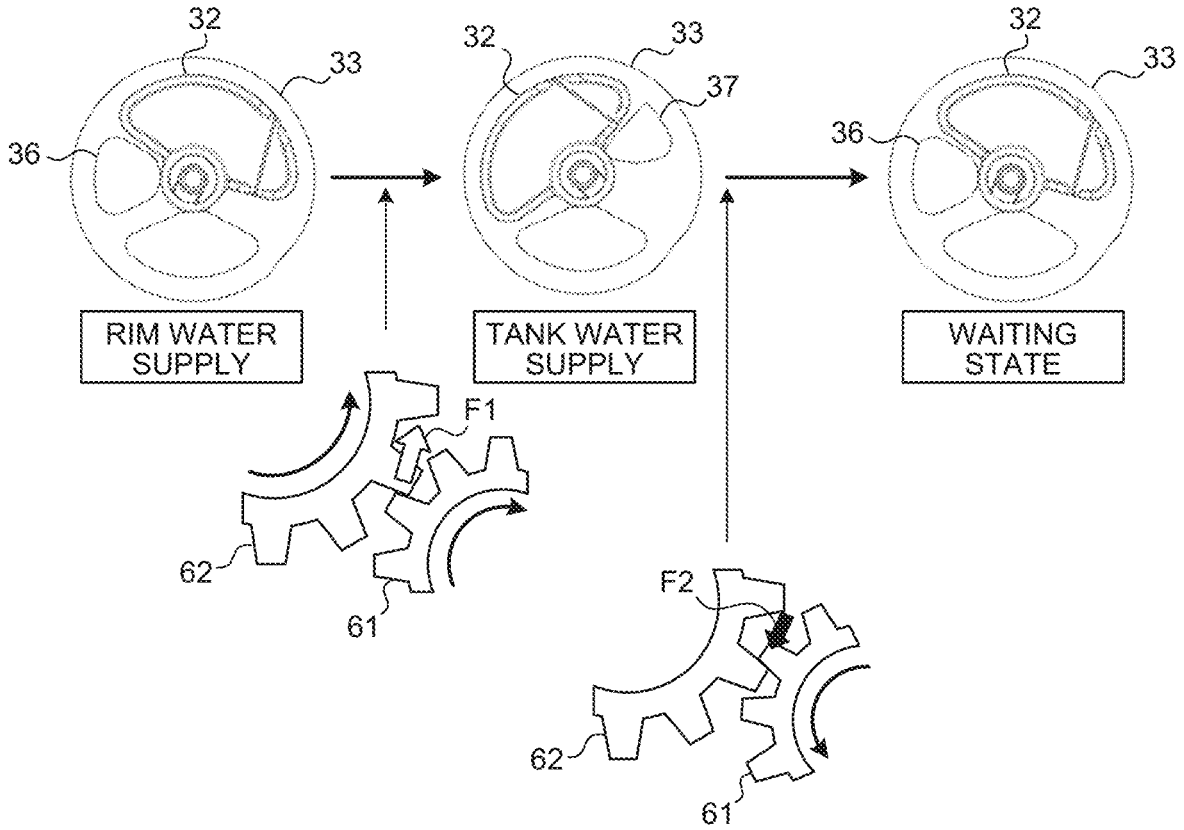
FIG. 8 is an explanatory diagram of power transmission in a flow channel switching part.

FIG. 8 is an explanatory diagram of power transmission in the flow channel switching part 315. Additionally, FIG. 8 schematically illustrates a power transmission component(s) such as a plurality of gears between a motor and the rotor 32 as two gears 61, 62. As illustrated in FIG. 8, the flow channel switching part 315 opens the rim side opening part 36 of the stator 33 for a rim water spout.

The flow channel switching part 315 opens the tank side opening part 37 of the stator 33 as switching to tank water supply is executed. Furthermore, the flow channel switching part 315 has the plurality of gears 61, 62 for power transmission in an inside thereof. In a case where switching from rim water supply to tank water supply is executed, force F1 is transmitted from the gear 61 on an upstream side of power transmission to the gear 62 on a downstream side thereof.

Herein, it is preferable for the flow channel switching part 315 to return immediately from a state of tank water supply to a waiting state where the rim side opening part 36 is opened. Hence, for example, after the rotor 32 executes a rotation operation thereof, the gear 61 on an upstream side of power transmission is reversely rotated slightly as long as a state after the rotor 32 executes a rotation operation thereof is not changed, and close contact is attained by force F2 in such a manner that a mutual gap for the gear 62 on a downstream side is cleared. Thereby, it is possible to reduce backlash of the gear 61 preliminarily.

Figure 9:
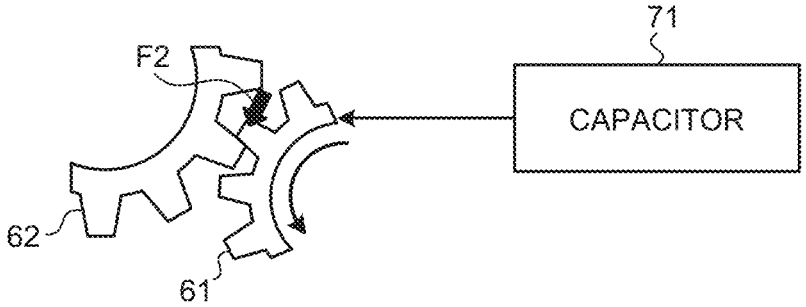
FIG. 9 is an explanatory diagram of a backlash reduction means in a flow channel switching part.

Furthermore, an example of a more specific backlash reduction means will be explained with reference to FIG. 9. FIG. 9 is an explanatory diagram of a backlash reduction means in the flow channel switching part 315.

As illustrated in FIG. 9, for a backlash reduction means in the flow channel switching part 315, for example, it is possible to use the capacitor 71 that provides a driving force to the rotor 32 at a moment when the electrical power failure detection part 350 (see FIG. 1) detects electrical power failure. As described above, the capacitor 71 is a capacitor for driving for the flow channel switching part 315 and supplies electrical power to the control part 320 (see FIG. 1) so as to provide a driving force to the rotor 32 through the control part 320.

Then, after the rotor 32 executes a rotation operation thereof, the control part 320 controls the capacitor 71, for example, in such a manner that the gear 61 on an upstream side of power transmission is reversely rotated, as long as a state after the rotor 32 executes a rotation operation thereof is not changed.

Thereby, even in a case where the flush toilet apparatus 1 is used at a moment when electrical power failure is caused, it is possible to reduce backlash of the gears 61, 62 preliminarily at a time when the rotor 32 executes a rotation operation thereof so as to increase a washing water W1 that is supplied to the rim side water supply channel 326 and it is possible for the flow channel switching part 315 to execute flow channel adjustment quickly and reliably so as to increase a washing water W1 that is supplied to the rim side water supply channel 326.

As explained above, in the flush toilet apparatus 1 according to an embodiment, it is possible to execute flow channel adjustment so as to increase a washing water W1 that is supplied to the rim side water supply channel 326 even if the flow channel switching part 315 (the rotor 32) is provided in a state where a lot of water is supplied to the tank 316, at a moment when electrical power failure is caused. Thereby, in toilet washing at a time of electrical power failure, it is possible to prevent or reduce a situation where the tank 316 is filled with water by exceeding a water drainage performance of the overflow pipe 335 and/or a situation where water is leaked to an outside of the tank 316. Furthermore, in toilet washing at a time of electrical power failure, a washing water is spouted from the rim water spout port 25, so that it is possible for a user to view toilet washing that is executed and it is possible to eliminate concern of a user for using of the flush toilet apparatus 1 at a time of electrical power failure.

Furthermore, a washing water is not supplied to the tank side water supply channel 329 at a moment when the electrical power failure detection part 350 detects electrical power failure when a washing water is supplied to the tank side water supply channel 329, so that it is possible to attain a spout of a certain amount of a washing water from a rim side with no individual variability for the flush toilet apparatus 1, in toilet washing at a time of electrical power failure, regardless of a usage state of the flush toilet apparatus 1 at a moment when electrical power failure is caused.

Furthermore, in a case where the electrical power failure detection part 350 detects electrical power failure when a washing water is supplied to the tank side water supply channel 329, the control part 320 controls electrical power supply from the capacitor 71 in such a manner that the flow channel switching part 315 (the rotor 32) does not supply a washing water to the tank side water supply channel 329, so that it is possible to attain a spout of a certain amount of a washing water from a rim side with no individual variability for the flush toilet apparatus 1, in toilet washing at a time of electrical power failure, regardless of a usage state of the flush toilet apparatus 1 in a case where electrical power failure is caused. In such a case, it is possible to provide a driving force to the flow channel switching part 315 (the rotor 32) by controlling electrical power supply from the capacitor 71, so that it is possible to prevent or reduce, or stop, supply of a washing water to the tank side water supply channel 329 at a time when electrical power failure is caused, by a simple configuration.

Furthermore, the dedicated capacitor 71 is used for driving of the flow channel switching part 315 (the rotor 32), so that there is no possibility of a lack of a capacitance of the capacitor 71 or the like at a time when electrical power failure is caused and it is possible for the flow channel switching part 315 to prevent or reduce, or stop, supply of a washing water to the tank side water supply channel 329 more reliably. Furthermore, it is possible to reduce a capacitance of a capacitor for driving of each site of the flush toilet apparatus 1, and further, it is possible to attain downsizing of the flush toilet apparatus 1 in association with reduction of a capacitance of such a capacitor for driving.

Furthermore, the gear 61 is reversely rotated as long as a state after a rotation operation of the flow channel switching part 315 (the rotor 32) is executed is not changed, so that it is possible to reduce backlash of the gears 61, 62 preliminarily at a time when the flow channel switching part 315 (the rotor 32) executes a rotation operation thereof so as to increase a washing water W1 that is supplied to the rim side water supply channel 326 even in a case where the flush toilet apparatus 1 is used at a moment when electrical power failure is caused. Thereby, it is possible for the flow channel switching part 315 (the rotor 32) to execute flow channel adjustment reliably so as to increase a washing water W1 that is supplied to the rim side water supply channel 326.

Furthermore, the tank side opening part 37 is formed into a protruding shape, in a rotation direction R1 so as to open the rim side opening part 36 of the flow channel switching part 315 (the rotor 32), on a downstream side of the rotation direction R1, so that supply of a washing water W1 to the rim side water supply channel 326 is increased by a slight rotation operation of the flow channel switching part 315 (the rotor 32), for example, even if flow channel adjustment so as to increase a washing water W1 that is supplied to the rim side water supply channel 326 is not well executed by the flow channel switching part 315 (the rotor 32) due to a lack of a capacitance of the capacitor 71, jamming of dust, and/or the like. That is, even in a case where the flow channel switching part 315 (the rotor 32) does not execute an envisaged rotation operation at a time when electrical power failure is caused, it is possible to prevent or reduce a situation where the tank 316 is filled with water by exceeding a water drainage performance of the overflow pipe 335 and/or a situation where water is leaked to an outside of the tank 316.

Furthermore, an opening area of the rim side opening part 36 is greater than an opening area of the tank side opening part 37, so that supply of a washing water W1 to the rim side water supply channel 326 is also increased by a slight rotation operation of the flow channel switching part 315 (the rotor 32), for example, even if flow channel adjustment so as to increase a washing water that is supplied to the rim side water supply channel 326 is not well executed by the flow channel switching part 315 (the rotor 32) due to a lack of a capacitance of the capacitor 71, jamming of dust, and/or the like. That is, even in a case where the flow channel switching part 315 (the rotor 32) does not execute an envisaged rotation operation at a time when electrical power failure is caused, it is possible to prevent or reduce a situation where the tank 316 is filled with water by exceeding a water drainage performance of the overflow pipe 335 and/or a situation where water is leaked to an outside of the tank 316.

Furthermore, the electrical power failure detection part 350 detects electrical power failure in a case where a current-carrying signal is interrupted longer than a time period when a current-carrying signal is interrupted in a normal state, so that it is possible to attain detection of electrical power failure by a simple configuration.

Additionally, although a configuration in an embodiment as described above is provided in such a manner that the flow channel switching part 315 (the rotor 32) is driven by using the capacitor 71, a configuration may be provided in such a manner that the rotor 32 is driven by a spring instead of the capacitor 71. For example, a spring is incorporated in a motor for driving that drives the rotor 32 and provides pressing force to the flow channel switching part 315 (the rotor 32) so as to provide driving force to the flow channel switching part 315 (the rotor 32) in a case where the electrical power failure detection part 350 detects electrical power failure. Thereby, it is possible to drive the flow channel switching part 315 (the rotor 32) by a simple configuration that does not rely on the control part 320.

Furthermore, for a spring, for example, a torsion spring is used. Such a spring presses the rotor 32 in a direction where the rim side opening part 36 is always opened, relative to an output shaft of a motor for driving. In such a case, when electrical control is not executed, the rim side opening part 36 is opened by a spring. Then, when electrical control is applied thereto, the rotor 32 is rotated by a torque that is a pressing force of a spring or greater, so that opening of the tank side opening part 37 is maintained. Additionally, when opening of the tank side opening part 37 is maintained, current carrying is always executed for a motor for driving in such a manner that returning to an opening state of the rim side opening part 36 is not caused by pressing force of a spring.

Also in such a configuration, it is possible to attain a spout of a certain amount of a washing water from a rim side with no individual variability for the flush toilet apparatus 1, in toilet washing at a time of electrical power failure, regardless of a usage state of the flush toilet apparatus 1 in a case where electrical power failure is caused. In such a case, it is possible to provide driving force to the flow channel switching part 315 (the rotor 32) by pressing force of a spring, so that it is possible to prevent or reduce, or stop, supply of a washing water to the tank side water supply channel 329 at a time when electrical power failure is caused, by a simple configuration.

Furthermore, although a configuration in an embodiment as described above is provided in such a manner that a washing water W2 that is supplied to the tank side water supply channel 329 is decreased and a washing water W1 that is supplied to the rim side water supply channel 326 is increased, at a moment when the electrical power failure detection part 350 detects electrical power failure, as an example of a case where the electrical power failure detection part 350 detects electrical power failure, this is not limiting, and a configuration may be provided, for example, in such a manner that a washing water W2 that is supplied to the tank side water supply channel 329 is decreased and a washing water W1 that is supplied to the rim side water supply channel 326 is increased, after a predetermined time period (for example, several seconds) has passed since the electrical power failure detection part 350 detects electrical power failure.

Also in such a configuration, it is possible to prevent or reduce a situation where the tank 316 is filled with water by exceeding a water drainage performance of the overflow pipe 335 and/or a situation where water is leaked to an outside of the tank 316, in toilet washing at a time of electrical power failure, and further, a washing water is spouted from the rim water spout port 25 in toilet washing at a time of electrical power failure, so that it is possible for a user to view toilet washing that is executed.

An aspect of an embodiment aims to provide a flush toilet apparatus that executes flow channel adjustment so as to increase a washing water that is supplied to a rim side water supply channel at a time when electrical power failure is caused, so that it is possible to prevent or reduce a situation where a tank is filled with water and/or a situation where water is leaked to an outside of such a tank.

A flush toilet apparatus according to an aspect of an embodiment is a flush toilet apparatus that discharges waste to a water drainage pipe by a washing water, including a toilet body that has a bowl part that receives waste, a rim water spout port that spouts a washing water to the bowl part, and a drainage water trap pipeline that is connected to a bottom part of the bowl part and discharges waste from the bowl part to the water drainage pipe, a tank that stores a washing water that is supplied from a water supply channel, an on-off valve that opens or closes the water supply channel, a rim side water supply channel that supplies a washing water to the rim water spout port through a branching part that is provided on a downstream side of the water supply channel, a tank side water supply channel that supplies a washing water to the tank through the branching part, a flow channel switching part that is provided on the branching part and is operated so as to adjust an amount of a washing water that is supplied to one or both of the rim side water supply channel and the tank side water supply channel, a control part that controls the on-off valve and the flow channel switching part, and an electrical power failure detection part that detects electrical power failure, wherein the control part is characterized in that, in a case where the electrical power failure detection part detects electrical power failure when a washing water is supplied to the tank side water supply channel, the flow channel switching part decreases a washing water that is supplied to the tank side water supply channel and increases a washing water that is supplied to the rim side water supply channel.

In such a configuration, in a case where electrical power failure is caused, it is possible to execute flow channel adjustment in such a manner that a flow channel switching part increases a washing water that is supplied to a rim side water supply channel even in a state where a lot of water is supplied to a tank. Thereby, in toilet washing at a time of electrical power failure, it is possible to prevent or reduce a situation where a tank is filled with water by exceeding a water drainage performance of an overflow pipe and/or a situation where water is leaked to an outside of such a tank. Furthermore, in toilet washing at a time of electrical power failure, a washing water is spouted from a rim water spout port, so that it is possible for a user to view toilet washing that is executed and it is possible for such a user to eliminate concern for using of a flush toilet apparatus at a time of electrical power failure.

Furthermore, the flush toilet apparatus as described above is characterized in that, in a case where the electrical power failure detection part detects electrical power failure when a washing water is supplied to the tank side water supply channel, the flow channel switching part does not supply a washing water to the tank side water supply channel.

In such a configuration, in toilet washing at a time of electrical power failure, it is possible to attain a spout of a certain amount of a washing water from a rim side with no individual variability for a flush toilet apparatus, regardless of a usage state of such a flush toilet apparatus in a case where such electrical power failure is caused.

Furthermore, the flush toilet apparatus as described above is characterized by including a capacitor that supplies electrical power for driving of each site in the flush toilet apparatus, wherein, in a case where the electrical power failure detection part detects electrical power failure when a washing water is supplied to the tank side water supply channel, the control part controls electrical power supply from the capacitor in such a manner that the flow channel switching part does not supply a washing water to the tank side water supply channel.

In such a configuration, in toilet washing at a time of electrical power failure, it is possible to attain a spout of a certain amount of a washing water from a rim side with no individual variability for a flush toilet apparatus, regardless of a usage state of such a flush toilet apparatus in a case where such electrical power failure is caused. In such a case, it is possible to control electrical power supply from a capacitor so as to provide driving force to a flow channel switching part, so that it is possible to prevent or reduce, or stop, supply of a washing water to a tank side water supply channel at a time when electrical power failure is caused, by a simple configuration.

Furthermore, the flush toilet apparatus as described above is characterized in that the capacitor has a capacitor for driving of the flow channel switching part separately.

In such a configuration, a dedicated capacitor is used for driving of a flow channel switching part, so that there is no possibility of a lack of a capacitance of a capacitor at a time when electrical power failure is caused or the like and it is possible to prevent or reduce, or stop, supply of a washing water to a tank side water supply channel by such a flow channel switching part more reliably. Furthermore, it is possible to reduce a capacitance of a capacitor for driving of each site in a flush toilet apparatus, and further, it is possible to attain downsizing of a flush toilet apparatus in association with reduction of a capacitance of such a capacitor for driving.

Furthermore, the flush toilet apparatus as described above is characterized by including a spring that provides pressing force to the flow channel switching part so as to provide driving force to the flow channel switching part in a case where the electrical power failure detection part detects electrical power failure, wherein, in a case where the electrical power failure detection part detects electrical power failure when a washing water is supplied to the tank side water supply channel, the spring provides pressing force to the flow channel switching part in such a manner that the flow channel switching part does not supply a washing water to the tank side water supply channel.

In such a configuration, in toilet washing at a time of electrical power failure, it is possible to attain a spout of a certain amount of a washing water from a rim side with no individual variability for a flush toilet apparatus, regardless of a usage state of such a flush toilet apparatus in a case where such electrical power failure is caused. In such a case, it is possible to provide driving force to a flow channel switching part by pressing force of a spring, so that it is possible to prevent or reduce, or stop, supply of a washing water to a tank side water supply channel at a time when electrical power failure is caused, by a simple configuration.

Furthermore, the flush toilet apparatus as described above is characterized in that the flow channel switching part has a gear for power transmission in an inside thereof, and the gear is reversely rotated as long as, after the flow channel switching part is operated from a state of water supply to the rim side water supply channel to a state of water supply to the tank side water supply channel, a state after the flow channel switching part is operated is not changed.

In such a configuration, even in a case where a flush toilet apparatus is used in a case where electrical power failure is caused (for example, at a moment when electrical power failure is caused), it is possible to reduce backlash of a gear preliminarily at a time when a flow channel switching part is operated so as to increase a washing water that is supplied to a rim side water supply channel, so that it is possible for such a flow channel switching part to execute flow channel adjustment reliably so as to increase a washing water that is supplied to such a rim side water supply channel.

Furthermore, the flush toilet apparatus as described above is characterized in that the flow channel switching part has a rim side opening part that supplies a washing water to the rim side water supply channel and a tank side opening part that supplies a washing water to the tank side water supply channel and is rotated around a rotation axis thereof as a center thereof so as to open the rim side opening part and/or the tank side opening part, and the tank side opening part is formed into a protruding shape, in a rotation direction so as to open the rim side opening part of the flow channel switching part, on a downstream side of the rotation direction.

In such a configuration, for example, even if flow channel adjustment so as to increase a washing water that is supplied to a rim side water supply channel is not well executed by a flow channel switching part due to a lack of a capacitance of a capacitor, jamming of dust on such a flow channel switching part, and/or the like, supply of a washing water to such a rim side water supply channel is increased by a slight operation of such a flow channel switching part. That is, even in a case where a flow channel switching part does not execute an envisaged operation at a time when electrical power failure is caused, it is possible to prevent or reduce a situation where a tank is filled with water by exceeding a water drainage performance of an overflow pipe and/or a situation where water is leaked to an outside of such a tank.

Furthermore, the flush toilet apparatus as described above is characterized in that the flow channel switching part has a rim side opening part that supplies a washing water to the rim side water supply channel and a tank side opening part that supplies a washing water to the tank side water supply channel and is rotated around a rotation axis thereof as a center thereof so as to open the rim side opening part and/or the tank side opening part, and an opening area of the rim side opening part is greater than an opening area of the tank side opening part.

In such a configuration, for example, even if flow channel adjustment so as to increase a washing water that is supplied to a rim side water supply channel is not well executed by a flow channel switching part due to a lack of a capacitance of a capacitor, jamming of dust on such a flow channel switching part, and/or the like, supply of a washing water to such a rim side water supply channel is increased by a slight operation of such a flow channel switching part. That is, even in a case where a flow channel switching part does not execute an envisaged operation at a time when electrical power failure is caused, it is possible to prevent or reduce a situation where a tank is filled with water by exceeding a water drainage performance of an overflow pipe and/or a situation where water is leaked to an outside of such a tank.

Furthermore, the flush toilet apparatus as described above is characterized in that the electrical power failure detection part detects electrical power failure in a case where a current-carrying signal is interrupted longer than a time period when the current-carrying signal is interrupted in a normal state.

In such a configuration, it is possible for an electrical power failure detection part to attain detection of electrical power failure by a simple configuration.

According to an aspect of an embodiment, flow channel adjustment is executed so as to increase a washing water that is supplied to a rim side water supply channel at a time when electrical power failure is caused, so that it is possible to prevent or reduce a situation where a tank is filled with water and/or a situation where water is leaked to an outside of such a tank.

It is possible for a person(s) skilled in the art to readily derive an additional effect(s) and/or variation(s). Hence, a broader aspect(s) of the present invention is/are not limited to a specific detail(s) and a representative embodiment(s) as illustrated and described above. Therefore, various modifications are possible without departing from the spirit or scope of a general inventive concept that is defined by the appended claim(s) and an equivalent(s) thereof.

What is claimed is:

1. A flush toilet apparatus that discharges waste to a water drainage pipe by washing water, comprising:

a toilet body that includes a bowl part that receives waste, a rim water spout port that spouts washing water to the bowl part, and a drainage water trap pipeline that is connected to a bottom part of the bowl part and discharges waste from the bowl part to the water drainage pipe;

a tank that stores washing water that is supplied from a water supply channel;

an on-off valve that opens or closes the water supply channel;

a rim side water supply channel that supplies washing water to the rim water spout port through a branching part that is provided on a downstream side of the water supply channel;

a tank side water supply channel that supplies washing water to the tank through the branching part;

a flow channel switching part that is provided on the branching part and is operated to adjust an amount of washing water that is supplied to one or both of the rim side water supply channel and the tank side water supply channel;

a control part that controls the on-off valve and the flow channel switching part; and an electrical power failure detection part that detects electrical power failure, wherein, in a case where the electrical power failure detection part detects electrical power failure when washing water is supplied to the tank side water supply channel, the flow channel switching part decreases washing water that is supplied to the tank side water supply channel and increases washing water that is supplied to the rim side water supply channel.

2. The flush toilet apparatus according to claim 1, wherein, in a case where the electrical power failure detection part detects electrical power failure when washing water is supplied to the tank side water supply channel, the flow channel switching part does not supply washing water to the tank side water supply channel.

3. The flush toilet apparatus according to claim 1, further comprising a capacitor that supplies electrical power for driving of each site in the flush toilet apparatus, wherein, in a case where the electrical power failure detection part detects electrical power failure when washing water is supplied to the tank side water supply channel, the control part controls electrical power supply from the capacitor in such a manner that the flow channel switching part does not supply washing water to the tank side water supply channel.

4. The flush toilet apparatus according to claim 3, wherein the capacitor includes a capacitor for driving of the flow channel switching part separately.

5. The flush toilet apparatus according to claim 1, further comprising a spring that provides pressing force to the flow channel switching part to provide driving force to the flow channel switching part in a case where the electrical power failure detection part detects electrical power failure, wherein, in a case where the electrical power failure detection part detects electrical power failure when washing water is supplied to the tank side water supply channel, the spring provides pressing force to the flow channel switching part in such a manner that the flow channel switching part does not supply washing water to the tank side water supply channel.

6. The flush toilet apparatus according to claim 1, wherein:

the flow channel switching part includes a gear for power transmission in an inside of the flow channel switching part; and the gear is reversely rotated as long as, after the flow channel switching part is operated from a state of water supply to the rim side water supply channel to a state of water supply to the tank side water supply channel, a state of the flow channel switching part after the flow channel switching part is operated is not changed.

7. The flush toilet apparatus according to claim 1, wherein:

the flow channel switching part includes a rim side opening part that supplies washing water to the rim side water supply channel and a tank side opening part that supplies washing water to the tank side water supply channel and is rotated around a rotation axis of the flow channel switching part as a center of the flow channel switching part to open the rim side opening part and/or the tank side opening part; and the tank side opening part is formed into a protruding shape, in a rotation direction to open the rim side opening part of the flow channel switching part, on a downstream side of the rotation direction.

8. The flush toilet apparatus according to claim 1, wherein:

the flow channel switching part includes a rim side opening part that supplies washing water to the rim side water supply channel and a tank side opening part that supplies washing water to the tank side water supply channel and is rotated around a rotation axis of the flow channel switching part as a center of the flow channel switching part to open the rim side opening part and/or the tank side opening part; and an opening area of the rim side opening part is greater than an opening area of the tank side opening part.

9. The flush toilet apparatus according to claim 1, wherein the electrical power failure detection part detects electrical power failure in a case where a current-carrying signal is interrupted longer than a time period when the current-carrying signal is interrupted in a normal state.

* * * * *